US011791090B2

(12) United States Patent
Kawachi et al.

(10) Patent No.: US 11,791,090 B2
(45) Date of Patent: Oct. 17, 2023

(54) COIL COMPONENT AND METHOD FOR MANUFACTURING THE SAME

(71) Applicant: Murata Manufacturing Co., Ltd., Kyoto-fu (JP)

(72) Inventors: Takao Kawachi, Nagaokakyo (JP); Hiroshi Okuizumi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 455 days.

(21) Appl. No.: 17/028,128

(22) Filed: Sep. 22, 2020

(65) Prior Publication Data

US 2021/0110965 A1 Apr. 15, 2021

(30) Foreign Application Priority Data

Oct. 9, 2019 (JP) ..... 2019-186178

(51) Int. Cl.
*H01F 27/28* (2006.01)
*H01F 27/29* (2006.01)
(Continued)

(52) U.S. Cl.
CPC ..... *H01F 27/29* (2013.01); *H01F 27/255* (2013.01); *H01F 41/0246* (2013.01); *H01F 41/04* (2013.01)

(58) Field of Classification Search
CPC .... H01F 27/29; H01F 27/255; H01F 41/0246; H01F 41/04; H01F 2017/048;
(Continued)

(56) References Cited

U.S. PATENT DOCUMENTS

2009/0231077 A1* 9/2009 Liao ..... H01F 17/04 29/606
2010/0259353 A1* 10/2010 Saito ..... H01F 27/327 336/205
(Continued)

FOREIGN PATENT DOCUMENTS

CN 101859641 A 10/2010
CN 105575621 A 5/2016
(Continued)

*Primary Examiner* — Shawki S Ismail
*Assistant Examiner* — Kazi S Hossain
(74) *Attorney, Agent, or Firm* — Studebaker & Brackett PC

(57) ABSTRACT

A coil component includes an element body and a coil conductor provided inside the element body, in which the element body has a substantially rectangular shape and has upper and lower surfaces facing each other in a winding axis direction of the coil conductor and first to fourth side surfaces. The element body includes a first magnetic body portion and a second magnetic body portion provided on a main surface of the first magnetic body portion. The coil conductor includes a winding portion and first and second extended portions extended to any side surface of the element body. The first magnetic body portion includes on the main surface thereof an outer convex portion and an inner convex portion provided outside and inside the winding portion, respectively. The outer convex portion is exposed only on one side surface or two adjacent side surfaces of the element body.

19 Claims, 7 Drawing Sheets

(51) Int. Cl.
*H01F 41/02* (2006.01)
*H01F 41/04* (2006.01)
*H01F 27/255* (2006.01)

(58) Field of Classification Search
CPC .... H01F 17/04; H01F 27/292; H01F 27/2847; H01F 27/306; H01F 27/26; H01F 27/2871
USPC ..... 336/221, 200
See application file for complete search history.

(56) References Cited

U.S. PATENT DOCUMENTS

| | | | | |
|---|---|---|---|---|
| 2016/0126006 | A1* | 5/2016 | Ahn | H01F 27/306 29/606 |
| 2018/0308609 | A1* | 10/2018 | Shinohara | H01F 27/292 |
| 2019/0304659 | A1* | 10/2019 | Tonogai | H01F 27/2823 |

FOREIGN PATENT DOCUMENTS

| | | | | |
|---|---|---|---|---|
| CN | 106816261 | A | | 6/2017 |
| JP | 2011-003761 | A | | 1/2011 |
| JP | 2013-110184 | A | | 6/2013 |
| JP | 2013110184 | A | * | 6/2013 |
| KR | 10-2016-0051583 | A | | 5/2016 |
| KR | 10-2017-0058852 | A | | 5/2017 |

* cited by examiner

COIL COMPONENT AND METHOD FOR MANUFACTURING THE SAME

CROSS-REFERENCE TO RELATED APPLICATION

This application claims benefit of priority to Japanese Patent Application No. 2019-186178, filed Oct. 9, 2019, the entire content of which is incorporated herein by reference.

BACKGROUND

Technical Field

The present disclosure relates to a coil component and a method for manufacturing the same.

Background Art

As a method for manufacturing a coil component, there has been known a method by which a magnetic sheet is pressed to an upper portion and a lower portion of a coil conductor to be made integrally.

Japanese Unexamined Patent Application Publication No. 2011-3761 discloses a molded coil in which a winding is sealed with a molded resin, the molded coil being configured such that, in a molded coil molded body in which a conductor having a large cross section is formed at least at a part of a winding terminal, at least a part of the conductor is electrically bonded to the winding, and at least a part of a conductor forming portion is embedded in the molded coil, at least a part of the conductor forming portion is electrically bonded with an outer electrode. The mold coil described in Japanese Unexamined Patent Application Publication No. 2011-3761 is formed by integrating a lower molding material, a winding, and an upper molding material by compression.

In a case where the coil component is manufactured by such a method described in Japanese Unexamined Patent Application Publication No. 2011-3761, it is required to increase bonding strength between the lower molding material and the upper molding material that configure an element body of the coil component. Further, it is also required to suppress positional deviation of the coil conductor in the coil component.

SUMMARY

Accordingly, the present disclosure provides a coil component in which bonding strength of a magnetic body portion configuring an element body is high and positional deviation of a coil conductor is suppressed, and a method for manufacturing the same.

As a result of intensive studies, the present inventors have found that by providing unevenness, inside an element body of a coil component, having a specific shape between a first magnetic body portion and a second magnetic body portion configuring the element body, it is possible to increase the bonding strength of a magnetic body portion configuring the element body, and it is possible to suppress the positional deviation of a coil conductor, thereby completing the present disclosure.

According to a first aspect of the present disclosure, there is provided a coil component including an element body and a coil conductor provided inside the element body, in which the element body has a substantially rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface. The element body includes a first magnetic body portion containing first magnetic particles, and a second magnetic body portion provided on a main surface of the first magnetic body portion and containing second magnetic particles. The coil conductor includes a winding portion, and a first extended portion and a second extended portion extended to any side surface of the element body. The first magnetic body portion has, on the main surface, an outer convex portion provided at an outer side portion of the winding portion, and an inner convex portion provided at an inner side portion of the winding portion. The outer convex portion is exposed only on one side surface or on two adjacent side surfaces of the element body.

According to a second aspect of the present disclosure, there is provided a coil component including an element body and a coil conductor provided inside the element body, in which the element body has a substantially rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface. The element body includes a first magnetic body portion containing first magnetic particles, and a second magnetic body portion provided on a main surface of the first magnetic body portion and containing second magnetic particles. The coil conductor includes a winding portion, and a first extended portion and a second extended portion. The first magnetic body portion has four outer convex portions provided at an outer side portion of the winding portion on the main surface of the first magnetic body portion. A first outer convex portion is exposed only on the first side surface of the element body, a second outer convex portion is exposed only on the second side surface of the element body, a third outer convex portion is exposed only on the third side surface of the element body, and a fourth outer convex portion is exposed only on the fourth side surface of the element body. Also, at least a part of the first extended portion is embedded in the first outer convex portion, and at least a part of the second extended portion is embedded in the second outer convex portion.

According to a third aspect of the present disclosure, there is provided a coil component including an element body and a coil conductor provided inside the element body, in which the element body has a substantially rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface. The element body includes a first magnetic body portion containing first magnetic particles, and a second magnetic body portion provided on a main surface of the first magnetic body portion and containing second magnetic particles. The coil conductor includes a winding portion, and a first extended portion and a second extended portion. The first magnetic body portion has four outer convex portions provided at an outer side portion of the winding portion on the main surface of the first magnetic body portion. A first outer convex portion is exposed only on the first side surface and the third side surface of the element body, a second outer convex portion is exposed only on the second side surface and the fourth side surface of the element body, a third outer convex portion is exposed only on the second side surface and the third side surface of the element body, and a fourth outer convex portion is exposed only on the first side surface and the fourth side surface of the element body. Also, at least a part of the first extended portion is embedded in the first outer convex portion, and at least a part of the second extended portion is embedded in the second outer convex portion.

According to a fourth aspect of the present disclosure, there is provided a method for manufacturing any one of the above-described coil components. The method includes preparing a mold that has a concave portion corresponding to an outer dimension of a winding portion of a coil conductor, and one or a plurality of substantially groove-shaped concave portions located at an outer side portion of the concave portion and extending from the concave portion; disposing the coil conductor in the mold, in which at least a part of the winding portion of the coil conductor is disposed inside the concave portion in a manner such that the winding axis is substantially perpendicular to a bottom surface of the concave portion, and at least a part of at least one of first extended portion and second extended portion of the coil conductor is disposed inside the substantially groove-shaped concave portion. The method further includes pressing a first magnetic sheet containing first magnetic particles against the mold, and embedding at least a part of the coil conductor in the first magnetic sheet; removing the coil conductor and the first magnetic sheet from the mold; pressing a second magnetic sheet containing second magnetic particles on the first magnetic sheet and the coil conductor to form a multilayer body in which the first magnetic sheet and the second magnetic sheet are bonded to each other; and cutting the multilayer body to a predetermined dimension to obtain a coil component.

Other features, elements, characteristics and advantages of the present disclosure will become more apparent from the following detailed description of preferred embodiments of the present disclosure with reference to the attached drawings.

DETAILED DESCRIPTION

Hereinafter, one embodiment of the present disclosure will be described in detail with reference to the accompanying drawings. However, the embodiment described below is intended to be illustrative, and the present disclosure is not limited to the following embodiment.

Coil Component

Figure 1:
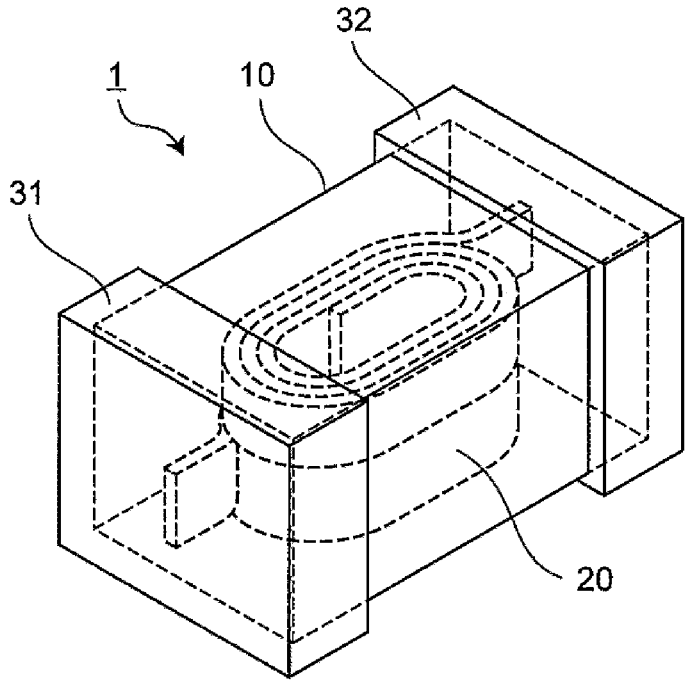
FIG. 1 is a transparent perspective view of a coil component according to one embodiment of the present disclosure.
Figure 2:
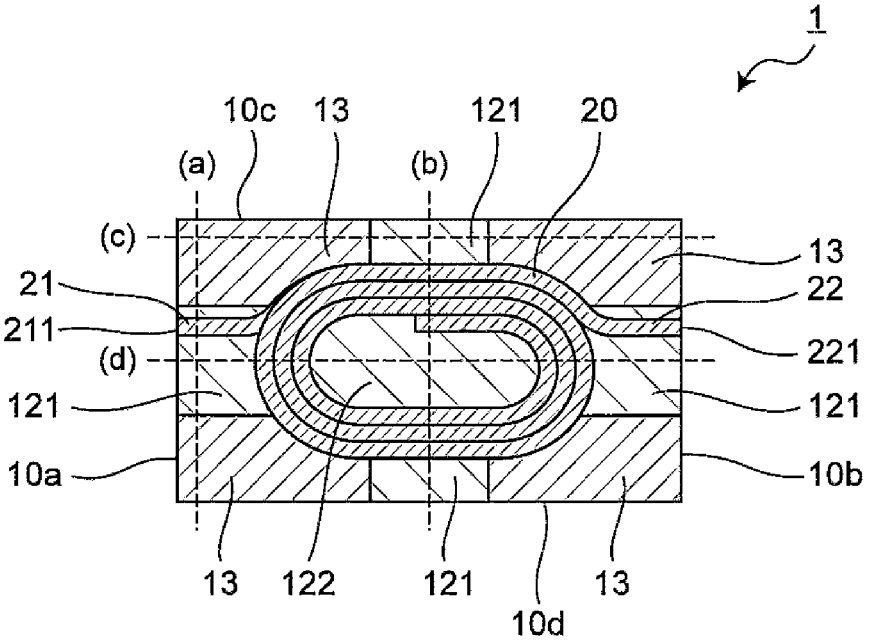
FIG. 2 is a cross-sectional view of the coil component passing through an upper surface of a coil conductor according to one embodiment of the present disclosure.
Figure 3A:
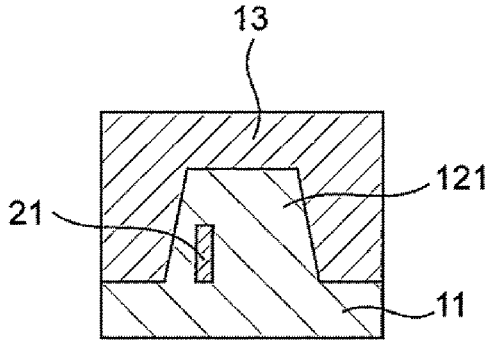
FIG. 3A is a cross-sectional view taken along lines (a) in FIG. 2.
Figure 3C:
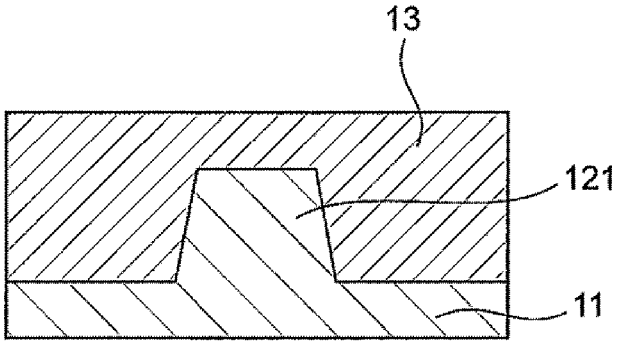
FIG. 3C is a cross-sectional view taken along lines (c) in FIG. 2.
Figure 3B:
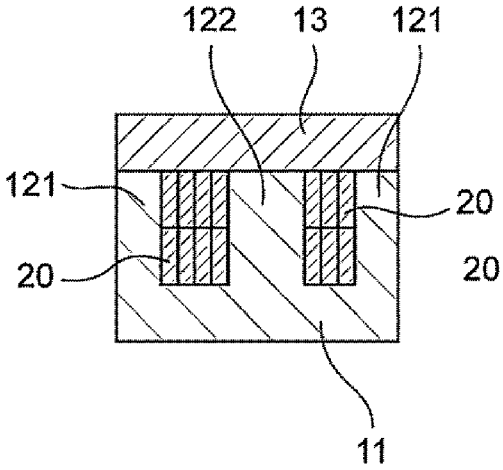
FIG. 3B is a cross-sectional view taken along lines (b) in FIG. 2.
Figure 3D:
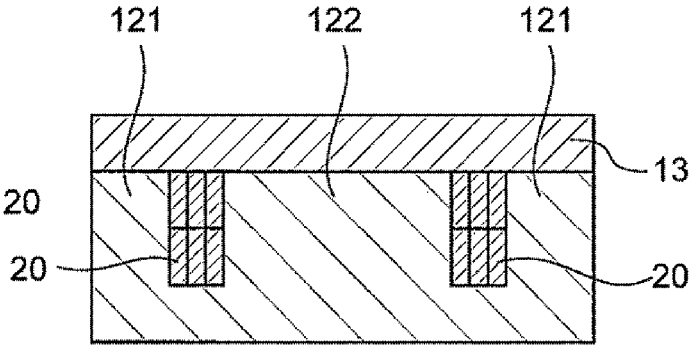
FIG. 3D is a cross-sectional view of the coil component taken along lines (d) in FIG. 2.

FIG. 1 is a transparent perspective view of a coil component 1 according to one embodiment of the present disclosure. FIG. 2 is a cross-sectional view of the coil component 1 illustrated in FIG. 1, which passes through an upper surface of a coil conductor 20. FIG. 3A is a cross-sectional view of the coil component illustrated in FIG. 2 taken along a line (a). FIG. 3B is a cross-sectional view of the coil component illustrated in FIG. 2 taken along a line (b). FIG. 3C is a cross-sectional view of the coil component illustrated in FIG. 2 taken along a line (c). FIG. 3D is a cross-sectional view of the coil component illustrated in FIG. 2 taken along a line (d).

The coil component 1 illustrated in FIG. 1 includes an element body 10 and the coil conductor 20 provided inside the element body 10. The coil component 1 illustrated in FIG. 1 further includes a first outer electrode 31 electrically connected to a first extended portion 21 of the coil conductor 20, and a second outer electrode 32 electrically connected to a second extended portion 22 of the coil conductor 20. However, the first outer electrode 31 and the second outer electrode 32 are not essential components, and the coil component 1 according to the present embodiment may not include the first outer electrode 31 and the second outer electrode 32. Further, in FIG. 2 to FIG. 14, the first outer electrode 31 and the second outer electrode 32 are omitted.

The element body 10 has a substantially rectangular shape having an upper surface and a lower surface facing each other in a winding axis direction of the coil conductor 20, a first side surface 10*a* and a second side surface 10*b* facing each other in a direction orthogonal to a winding axis, and a third side surface 10*c* and a fourth side surface 10*d* facing each other in a direction orthogonal to the winding axis and parallel to the first side surface and the second side surface.

As illustrated in FIG. 3A to FIG. 3D, the element body 10 includes a first magnetic body portion 11 containing first magnetic particles, and a second magnetic body portion 13 provided on a main surface of the first magnetic body portion 11 and containing second magnetic particles. The first magnetic body portion 11 and the second magnetic body portion 13 are provided so as to sandwich the coil conductor 20 from above and below. In other words, the coil conductor 20 is located between the first magnetic body portion 11 and the second magnetic body portion 13. The first magnetic particles and the second magnetic particles may be ceramic particles, such as ferrite particles, and also may be metal magnetic body particles. The first magnetic particles and the second magnetic particles may have a coating on a surface thereof. The first magnetic particles and the second magnetic particles may have the same composition and/or average particle size, or may have different compositions and/or average particle sizes from each other. The first magnetic body portion 11 and the second magnetic body portion 13 may contain a resin in addition to the magnetic particles. The first magnetic body portion 11 and the second magnetic body portion 13 may have the same composition (the type and blending amount of the first magnetic particles and the second magnetic particles, the type and blending amount of the resin, and the like), or may have different compositions from each other.

The coil conductor 20 includes a winding portion, and a first extended portion 21 and a second extended portion 22 extended to any side surface of the element body 10. In a configuration illustrated in FIG. 1 and FIG. 2, the first extended portion 21 of the coil conductor 20 is extended to the first side surface 10*a* of the element body 10, and the second extended portion 22 is extended to the second side surface 10*b* of the element body 10.

Figure 5:
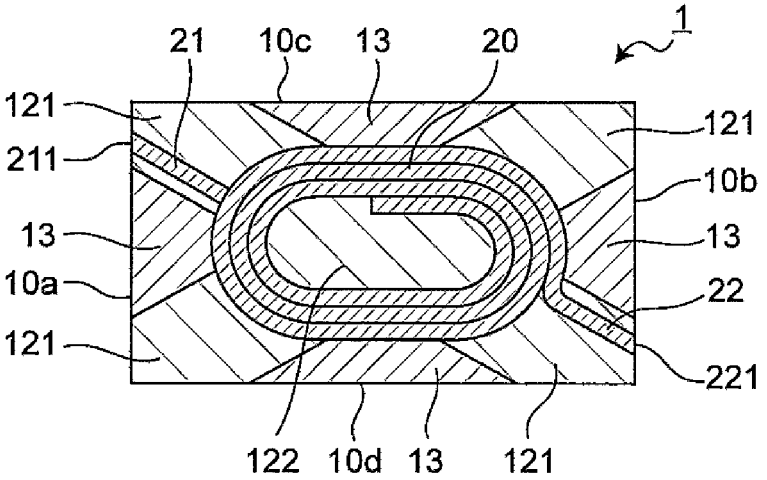
FIG. 5 is a cross-sectional view illustrating a second modified example of the coil component according to the present disclosure.

As illustrated in FIG. 3A to FIG. 3D, the first magnetic body portion 11 has, on the main surface thereof, an outer convex portion 121 provided at an outer side portion of the winding portion, and an inner convex portion 122 provided at an inner side portion of the winding portion. As illustrated in FIG. 5, the first magnetic body portion 11 may have only one outer convex portion 121 on the main surface thereof, and may have a plurality of outer convex portions 121. In the configuration illustrated in FIG. 2 to FIG. 3D, the first magnetic body portion 11 has four outer convex portions 121. In the configuration illustrated in FIG. 2 to FIG. 3D, each of the four outer convex portions 121 has the same height as an upper surface of the winding portion of the coil conductor 20, but the height of the outer convex portion 121 may be lower than the upper surface of the winding portion, and may be higher than the upper surface of the winding portion. Further, in the configuration illustrated in FIG. 2 to FIG. 3D, the four outer convex portions 121 each have the same height. However, when the first magnetic body portion 11 has the plurality of outer convex portions 121, the heights of the plurality of outer convex portions 121 may be the same, or may be different from each other.

The outer convex portions 121 are exposed only on one side surface or on two side surfaces adjacent to each other of the element body 10. In the configuration illustrated in FIG. 2, each of the outer convex portion 121 is exposed only on one side surface of the element body 10. On the other hand, in the configuration illustrated in FIG. 4, each of the outer convex portion 121 is exposed on two adjacent side surfaces of the element body 10.

At least a part of the first extended portion 21 or the second extended portion 22 of the coil conductor 20 is preferably embedded inside the outer convex portion 121. With this configuration, it is possible to more accurately control an extended position of the first extended portion 21 or the second extended portion 22 as will be described later. For example, in the configuration illustrated in FIG. 2 to FIG. 3D, the entirety of the first extended portion 21 of the coil conductor 20 is embedded inside the outer convex portion 121 as illustrated in FIG. 3A.

The inner convex portion 122 of the first magnetic body portion 11 is preferably provided so as to fill the winding portion of the coil conductor 20 as illustrated in FIG. 2 to FIG. 3D. Further, in the configuration illustrated in FIG. 2 to FIG. 3D, the inner convex portion 122 has the same height as the upper surface of the winding portion of the coil conductor 20, but the height of the inner convex portion 122 may be lower than the upper surface of the winding portion, and may be higher than the upper surface of the winding portion. In the configuration illustrated in FIG. 2 to FIG. 3D, the height of the inner convex portion 122 is the same as the height of the outer convex portion 121, but the inner convex portion 122 may have a height different from that of the outer convex portion 121.

In the coil component 1 according to the present embodiment, the first magnetic body portion 11 configuring the element body 10 has the outer convex portion 121 and the inner convex portion 122 as described above, whereby a contact area between the first magnetic body portion 11 and the second magnetic body portion 13 can be increased, and as a result, it is possible to improve the bonding strength between the first magnetic body portion 11 and the second magnetic body portion 13. Therefore, it is possible to prevent the first magnetic body portion 11 and the second magnetic body portion 13 from being peeled off from each other.

In addition, the coil component 1 according to the present embodiment has a structure in which the winding portion of the coil conductor 20 is sandwiched between the equal to or more than one outer convex portion 121 and the inner convex portion 122. In other words, in the coil component 1 according to the present embodiment, the winding portion of the coil conductor 20 is pressed by the equal to or more than one outer convex portion 121 and the inner convex portion 122. The coil component 1 has such a structure, so that it is possible to suppress the positional deviation of the coil conductor 20 when the coil component 1 is manufactured. Further, the winding portion of the coil conductor 20 is sandwiched between the equal to or more than one outer convex portion 121 and the inner convex portion 122, and thus it is possible to increase the bonding strength of the entire element body 10.

In addition, in the coil component 1 according to the present embodiment, it is preferable that at least a part of the first extended portion 21 or the second extended portion 22 of the coil conductor 20 be embedded inside the outer convex portion 121. With this configuration, it is possible to more accurately control an extended position on the side surface of the element body 10 of the first extended portion 21 or the second extended portion 22. Note that in a case where the first magnetic body portion 11 includes the plurality of outer convex portions 121, at least a part of each of the first extended portion 21 and the second extended portion 22 may be embedded in the outer convex portion 121. More specifically, at least a part of the first extended portion 21 may be embedded in one outer convex portion 121, and at least a part of the second extended portion 22 may be embedded in another outer convex portion 121.

Further, in the coil component 1 according to the present embodiment, the first magnetic body portion 11 has the outer convex portion 121 and the inner convex portion 122, and thus the discontinuous surface (boundary surface) exists between the first magnetic body portion 11 and the second magnetic body portion 13. The presence of such a non-continuous surface may improve DC superposition characteristics of the coil component 1. Also in the modified example as described later in which the first magnetic body portion 11 does not have the inner convex portions 122, the first magnetic body portion 11 has the plurality of outer convex portions 121, and thus the discontinuous surfaces (boundary surfaces) are present between the first magnetic body portion 11 and the second magnetic body portion 13, as a result, the DC superposition characteristics of the coil component 1 may be improved.

Next, a configuration example illustrated in FIG. 2 to FIG. 3D will be described in more detail. In the coil component illustrated in FIG. 2 to FIG. 3D, the first magnetic body portion 11 has the four outer convex portions (first outer convex portion, second outer convex portion, third outer convex portion, and fourth outer convex portion) 121. This makes it possible to further increase the contact area between the first magnetic body portion 11 and the second magnetic body portion 13, and to further improve the bonding strength between the first magnetic body portion 11 and the second magnetic body portion 13. The first outer convex portion 121 is exposed only on the first side surface 10*a* of the element body 10, the second outer convex portion 121 is exposed only on the second side surface 10*b* of the element body 10, the third outer convex portion 121 is exposed only on the third side surface 10*c* of the element body 10, and the fourth outer convex portion 121 is exposed only on the fourth side surface 10*d* of the element body 10. At least a part of the first extended portion 21 of the coil conductor 20 is embedded in the first outer convex portion 121, and at least a part of the second extended portion 22 is embedded in the second outer convex portion 121. Further, in FIG. 2 to FIG. 3D, the winding portion of the coil conductor 20 is held by the four outer convex portions 121 from four sides in a plan view. Accordingly, it is possible to more effectively suppress the positional deviation of the coil conductor 20. Further, FIG. 2 to FIG. 3D, both of the first extended portion 21 and the second extended portion 22 are embedded inside the first outer convex portion 121 and the second outer convex portion 121, respectively. With this configuration, it is possible to more accurately control extended positions of both the first extended portion 21 and the second extended portion 22.

Next, a first modified example of the coil component 1 according to the present embodiment will be described below with reference to FIG. 4. The coil component 1 according to the first modified example has a configuration similar to that of the coil component 1 illustrated in FIG. 2 to FIG. 3D except being different in arrangement of the outer convex portions 121. Therefore, the arrangement of the outer convex portions 121 is mainly described below, and descriptions of the other configurations will be omitted. The coil component 1 according to the first modified example can improve the bonding strength of the element body 10 and suppress the positional deviation of the coil conductor 20, similarly to the coil component 1 illustrated in FIG. 2 to FIG. 3D.

In the coil component 1 according to the first modified example, the first magnetic body portion 11 has four outer convex portions 121. The first extended portion 21 of the coil conductor 20 is extended to the third side surface 10*c* of the element body 10, and the second extended portion 22 is extended to the fourth side surface 10*d* of the element body 10. At least a part of the first extended portion 21 is embedded in the first outer convex portion 121, and at least a part of the second extended portion 22 is embedded in the second outer convex portion 121. Since both of the first extended portion 21 and the second extended portion 22 are embedded in the outer convex portion 121 as described above, it is possible to more accurately control the extended positions of the first extended portion 21 and the second extended portion 22.

Figure 4:
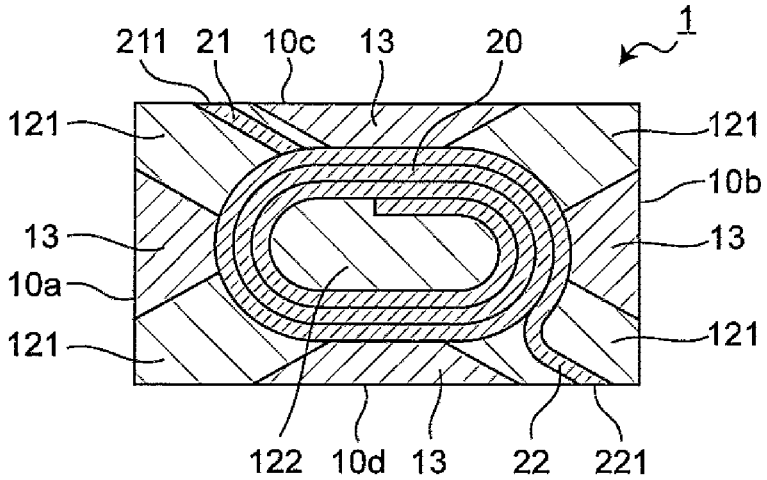
FIG. 4 is a cross-sectional view illustrating a first modified example of the coil component according to the present disclosure.

In the first modified example illustrated in FIG. 4, the first outer convex portion 121 is exposed only on the first side surface 10*a* and the third side surface 10*c* of the element body 10, the second outer convex portion 121 is exposed only on the second side surface 10*b* and the fourth side surface 10*d* of the element body 10, the third outer convex portion 121 is exposed only on the second side surface 10*b* and the third side surface 10*c* of the element body 10, and the fourth outer convex portion 121 is exposed only on the first side surface 10*a* and the fourth side surface 10*d* of the element body 10. In other words, the winding portion of the coil conductor 20 is held diagonally by the four outer convex portions 121 from four sides in a plan view. Also with such a configuration, the contact area between the first magnetic body portion 11 and the second magnetic body portion 13 can be further increased, and the bonding strength between the first magnetic body portion 11 and the second magnetic body portion 13 can be further increased. Further, it is possible to more effectively suppress the positional deviation of the coil conductor 20.

Note that, in the coil component 1 according to the first modified example illustrated in FIG. 4, the first magnetic body portion 11 has the inner convex portion 122 in addition to the four outer convex portions 121, but the first magnetic body portion 11 does not need to have the inner convex portion 122, and may have only the four outer convex portions 121, as will be described later. Also with such a configuration, the contact area between the first magnetic body portion 11 and the second magnetic body portion 13 can be further increased, and the bonding strength between the first magnetic body portion 11 and the second magnetic body portion 13 can be further increased. Further, it is possible to more effectively suppress the positional deviation of the coil conductor 20.

Next, a second modified example of the coil component 1 according to the present embodiment will be described below with reference to FIG. 5. The coil component 1 according to the second modified example has a configuration similar to that of the first modified example described above except being different in extended positions of the first extended portion 21 and the second extended portion 22 of the coil conductor 20. Therefore, the extended positions of the first extended portion 21 and the second extended portion 22 will be mainly described below, and descriptions of the other configurations will be omitted. The coil component 1 according to the second modified example can improve the bonding strength of the element body 10 and suppress the positional deviation of the coil conductor 20, similarly to the coil component 1 according to the first modified example of FIG. 4.

In the coil component 1 according to the second modified example, the first magnetic body portion 11 has four outer convex portions 121. The first extended portion 21 of the coil conductor 20 is extended to the first side surface 10*a* of the element body 10, and the second extended portion 22 is extended to the second side surface 10*b* of the element body 10. At least a part of the first extended portion 21 is embedded in the first outer convex portion 121, and at least a part of the second extended portion 22 is embedded in the second outer convex portion 121. Since both of the first extended portion 21 and the second extended portion 22 are embedded in the outer convex portion 121 as described above, it is possible to more accurately control the extended positions of the first extended portion 21 and the second extended portion 22.

In the coil component 1 according to the second modified example illustrated in FIG. 5, the first magnetic body portion 11 includes the inner convex portion 122 in addition to the four outer convex portions 121, but the first magnetic body portion 11 does not need to have the inner convex portion 122, and may have only the four outer convex portions 121. Also with such a configuration, the contact area between the first magnetic body portion 11 and the second magnetic body portion 13 can be further increased, and the bonding strength between the first magnetic body portion 11 and the second magnetic body portion 13 can be further increased. Further, it is possible to more effectively suppress the positional deviation of the coil conductor 20.

Figure 6:
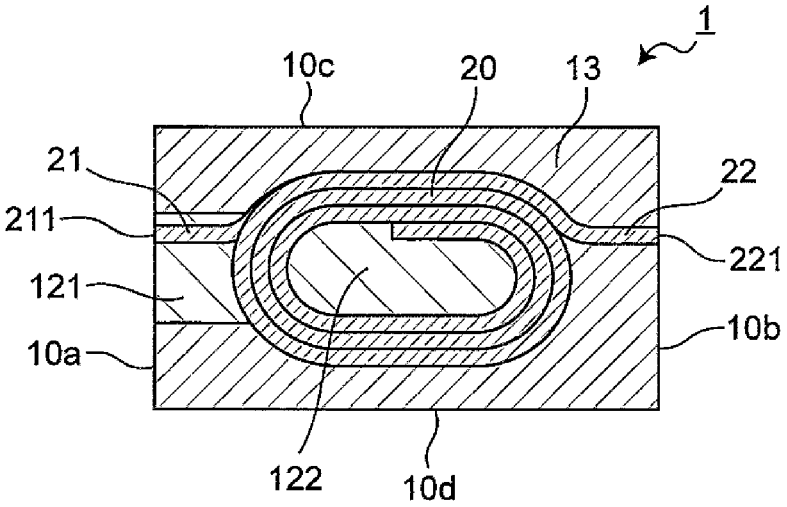
FIG. 6 is a cross-sectional view illustrating a third modified example of the coil component according to the present disclosure.

Next, a third modified example of the coil component 1 according to the present embodiment will be described below with reference to FIG. 6. The coil component 1 according to the third modified example has a configuration similar to that of the coil component 1 illustrated in FIG. 2 to FIG. 3D except being different in the number of the outer convex portions 121. Therefore, the number of the outer convex portions 121 will be mainly described below, and descriptions of the other configurations will be omitted. The coil component 1 according to the third modified example can improve the bonding strength of the element body 10 and suppress the positional deviation of the coil conductor 20, similarly to the coil component 1 illustrated in FIG. 2 to FIG. 3D.

In the coil component 1 according to the third modified example, the first magnetic body portion 11 has only one outer convex portion 121. In this regard, the coil component 1 according to the third modified example differs from the coil component 1 in FIG. 2 to FIG. 5 in which the first magnetic body portion 11 has the plurality of outer convex portions 121. Even in the case where the first magnetic body portion 11 has only one outer convex portion 121 as described above, the contact area between the first magnetic body portion 11 and the second magnetic body portion 13 can be increased by the presence of the outer convex portion 121 and the inner convex portion 122, and the bonding strength between the first magnetic body portion 11 and the second magnetic body portion 13 can be increased. Further, the winding portion of the coil conductor 20 is sandwiched between the outer convex portion 121 and the inner convex portion 122, and thus it is possible to suppress the positional deviation of the coil conductor 20. In addition, as illustrated in FIG. 6, at least a part of the first extended portion 21 of the coil conductor 20 is embedded in the first outer convex portion 121. Since the first extended portion 21 is embedded in the outer convex portion 121 as described above, the extended position of the first extended portion 21 can be more accurately controlled.

Figure 7:
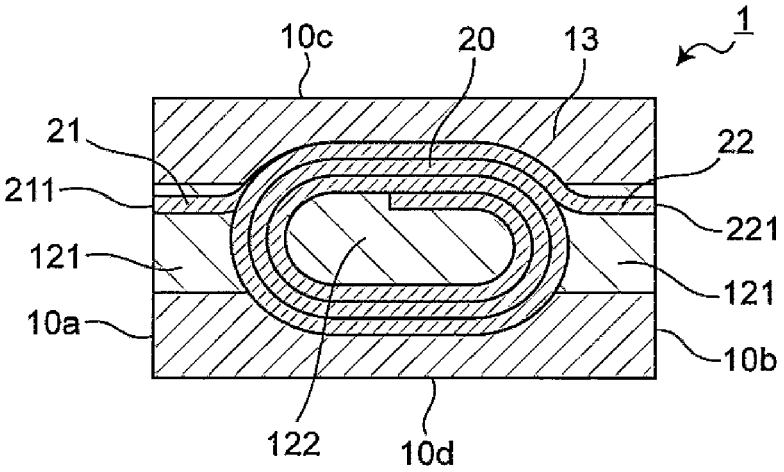
FIG. 7 is a cross-sectional view illustrating a fourth modified example of the coil component according to the present disclosure.

Next, a fourth modified example of the coil component 1 according to the present embodiment will be described below with reference to FIG. 7. The coil component 1 according to the fourth modified example has a configuration similar to that of the coil component 1 illustrated in FIG. 2 to FIG. 3D except being different in the number of the outer convex portions 121. Therefore, the number of the outer convex portions 121 will be mainly described below, and descriptions of the other configurations will be omitted. The coil component 1 according to the fourth modified example can improve the bonding strength of the element body 10 and suppress the positional deviation of the coil conductor 20, similarly to the coil component 1 illustrated in FIG. 2 to FIG. 3D.

In the coil component 1 according to the fourth modified example, the first magnetic body portion 11 has two outer convex portions 121. In this respect, the coil component 1 according to the fourth modified example differs from the coil component 1 in FIG. 2 to FIG. 5 in which the first magnetic body portion 11 has the four outer convex portions 121. Even in the case where the first magnetic body portion 11 includes two outer convex portions 121 as described above, the contact area between the first magnetic body portion 11 and the second magnetic body portion 13 can be increased by the presence of the outer convex portion 121 and the inner convex portion 122, and the bonding strength between the first magnetic body portion 11 and the second magnetic body portion 13 can be increased. Further, the winding portion of the coil conductor 20 is sandwiched between the outer convex portion 121 and the inner convex portion 122, and thus it is possible to suppress the positional deviation of the coil conductor 20. In addition, in the configuration illustrated in FIG. 7, at least a part of the first extended portion 21 and at least a part of the second extended portion 22 of the coil conductor 20 are embedded in the outer convex portions 121, respectively. Since both of the first extended portion 21 and the second extended portion 22 are embedded in the outer convex portion 121 as described above, it is possible to more accurately control the extended positions of the first extended portion 21 and the second extended portion 22. Note that in FIG. 7, each of the two outer convex portions 121 is disposed so as to be exposed only on one side surface of the element body 10, but the two outer convex portions 121 can be provided at arbitrary positions, the positions being not limited to a configuration example illustrated in FIG. 7, in accordance with applications and the like.

Figure 8:
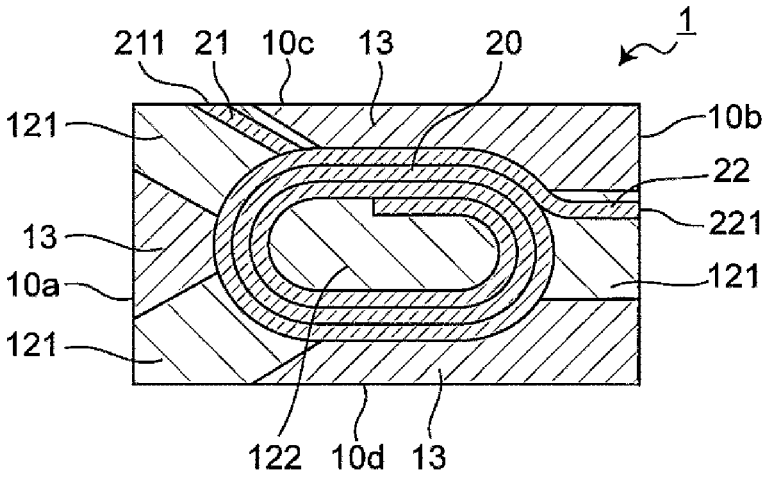
FIG. 8 is a cross-sectional view illustrating a fifth modified example of the coil component according to the present disclosure.

Next, a fifth modified example of the coil component 1 according to the present embodiment will be described below with reference to FIG. 8. The coil component 1 according to the fifth modified example has a configuration similar to that of the coil component 1 illustrated in FIG. 2 to FIG. 3D except being different in the number of the outer convex portions 121. Therefore, the number of the outer convex portions 121 will be mainly described below, and descriptions of the other configurations will be omitted. The coil component 1 according to the fifth modified example can improve the bonding strength of the element body 10 and suppress the positional deviation of the coil conductor 20, similarly to the coil component 1 illustrated in FIG. 2 to FIG. 3D.

In the coil component 1 according to the fifth modified example, the first magnetic body portion 11 has three outer convex portions 121. In this respect, the coil component 1 according to the fifth modified example differs from the coil component 1 in FIG. 2 to FIG. 5 in which the first magnetic body portion 11 has four outer convex portions 121. Even in the case where the first magnetic body portion 11 has three outer convex portions 121 as described above, the outer convex portion 121 and the inner convex portion 122 are present, so that the contact area between the first magnetic body portion 11 and the second magnetic body portion 13 can be increased, and the bonding strength between the first magnetic body portion 11 and the second magnetic body portion 13 can be increased. Further, the winding portion of the coil conductor 20 is sandwiched between the outer convex portion 121 and the inner convex portion 122, and thus it is possible to suppress the positional deviation of the coil conductor 20. In addition, as illustrated in FIG. 8, at least a part of the first extended portion 21 and at least a part of the second extended portion 22 of the coil conductor 20 are embedded in the outer convex portions 121, respectively. Since both of the first extended portion 21 and the second extended portion 22 are embedded in the outer convex portion 121 as described above, it is possible to more accurately control the extended positions of the first extended portion 21 and the second extended portion 22. Note that, in FIG. 8, two outer convex portions 121 among the three outer convex portions 121 are disposed so as to be exposed on two side surfaces of the element body 10, and the remaining one outer convex portion 121 is disposed so as to be exposed only on one side surface of the element body 10, however, the three outer convex portions 121 can be provided at arbitrary positions, the positions being not limited to a configuration example illustrated in FIG. 8, in accordance with applications and the like.

Next, a sixth modified example of the coil component 1 according to the present embodiment will be described below with reference to FIG. 9. The coil component 1 according to the sixth modified example has a configuration similar to that of the coil component 1 illustrated in FIG. 2 to FIG. 3D except that the first magnetic body portion 11 does not have the inner convex portion 122. Therefore, only the above-described difference will be mainly described below, and descriptions of the other configurations will be omitted. The coil component 1 according to the sixth modified example can improve the bonding strength of the element body 10 and suppress the positional deviation of the coil conductor 20, similarly to the coil component 1 illustrated in FIG. 2 to FIG. 3D.

In the coil component 1 according to the sixth modified example, the first magnetic body portion 11 does not have the inner convex portion 122, and has only four outer convex portions 121. In the third modified example illustrated in FIG. 9, the first outer convex portion 121 is exposed only on the first side surface 10*a* of the element body 10, the second outer convex portion 121 is exposed only on the second side surface 10*b* of the element body 10, the third outer convex portion 121 is exposed only on the third side surface 10*c* of the element body 10, and the fourth outer convex portion 121 is exposed only on the fourth side surface 10*d* of the element body 10. At least a part of the first extended portion 21 is embedded in the first outer convex portion 121, and at least a part of the second extended portion 22 is embedded in the second outer convex portion 121.

Figure 9:
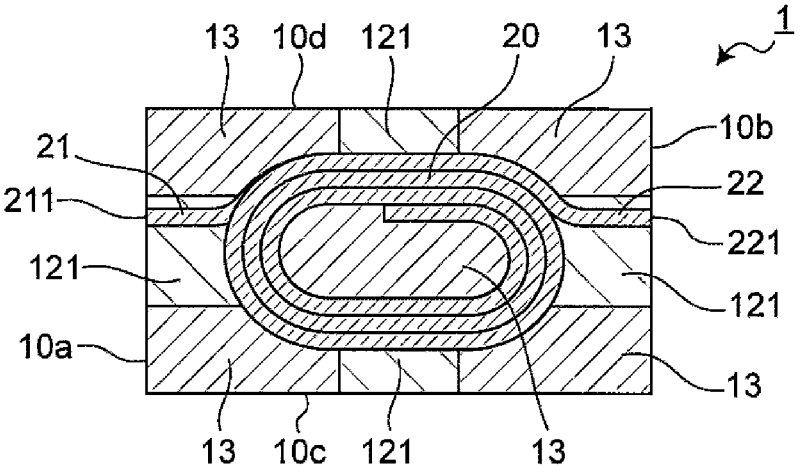
FIG. 9 is a cross-sectional view illustrating a sixth modified example of the coil component according to the present disclosure.

As illustrated in FIG. 9, even in a case where the first magnetic body portion 11 does not have the inner convex portion 122, the winding portion of the coil conductor 20 is pressed by the four outer convex portions 121 from four sides in a plan view, so that the positional deviation of the coil conductor 20 can be suppressed when the coil component 1 is formed. Further, since the first magnetic body portion 11 has the four outer convex portions 121, even in the case where the inner convex portion 122 is not present, the contact area between the first magnetic body portion 11 and the second magnetic body portion 13 can be increased, and as a result, the bonding strength between the first magnetic body portion 11 and the second magnetic body portion 13 can be improved.

Next, a seventh modified example of the coil component 1 according to the present embodiment will be described below with reference to FIG. 10. The coil component 1 according to the seventh modified example has a configuration similar to that of the coil component 1 according to the first modified example of FIG. 4 except that the first magnetic body portion 11 does not have the inner convex portion 122. Therefore, only the above-described difference will be mainly described below, and descriptions of the other configurations will be omitted. The coil component 1 according to the seventh modified example can improve the bonding strength of the element body 10 and suppress the positional deviation of the coil conductor 20, similarly to the coil component 1 illustrated in FIG. 2 to FIG. 3D.

In the coil component 1 according to the seventh modified example, the first magnetic body portion 11 does not have the inner convex portion 122, and has only four outer convex portions 121. In the seventh modified example illustrated in FIG. 10, the first outer convex portion 121 is exposed only on the first side surface 10*a* and the third side surface 10*c* of the element body 10, the second outer convex portion 121 is exposed only on the second side surface 10*b* and the fourth side surface 10*d* of the element body 10, and the third outer convex portion 121 is exposed only on the second side surface 10*b* and the third side surface 10*c* of the element body 10, and the fourth outer convex portion 121 is exposed only on the first side surface 10*a* and the fourth side surface 10*d* of the element body 10. The first extended portion 21 of the coil conductor 20 is extended to the third side surface 10*c* of the element body 10, and the second extended portion 22 is extended to the fourth side surface 10*d* of the element body 10. At least a part of the first extended portion 21 is embedded in the first outer convex portion 121, and at least a part of the second extended portion 22 is embedded in the second outer convex portion 121.

Figure 10:
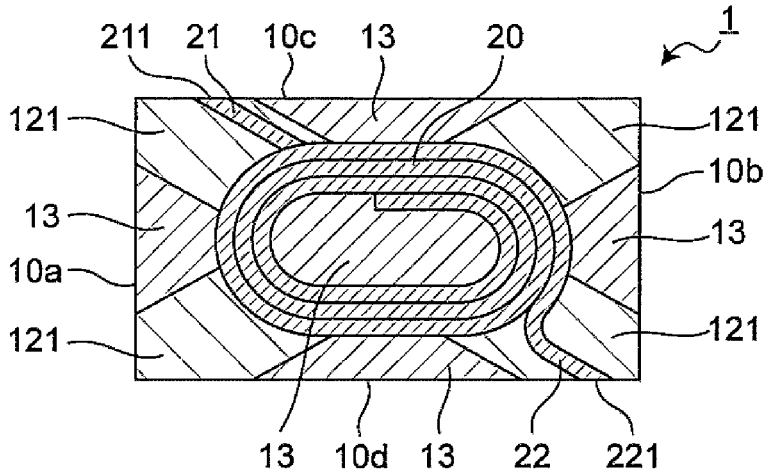
FIG. 10 is a cross-sectional view illustrating a seventh modified example of the coil component according to the present disclosure.

As illustrated in FIG. 10, even in a case where the first magnetic body portion 11 does not have the inner convex portion 122, the winding portion of the coil conductor 20 is pressed by the four outer convex portions 121 from four sides in a plan view, so that the positional deviation of the coil conductor 20 can be suppressed when the coil component 1 is formed. Further, since the first magnetic body portion 11 has the four outer convex portions 121, even in the case where the inner convex portion 122 is not present, the contact area between the first magnetic body portion 11 and the second magnetic body portion 13 can be increased, and as a result, the bonding strength between the first magnetic body portion 11 and the second magnetic body portion 13 can be improved.

Figure 11:
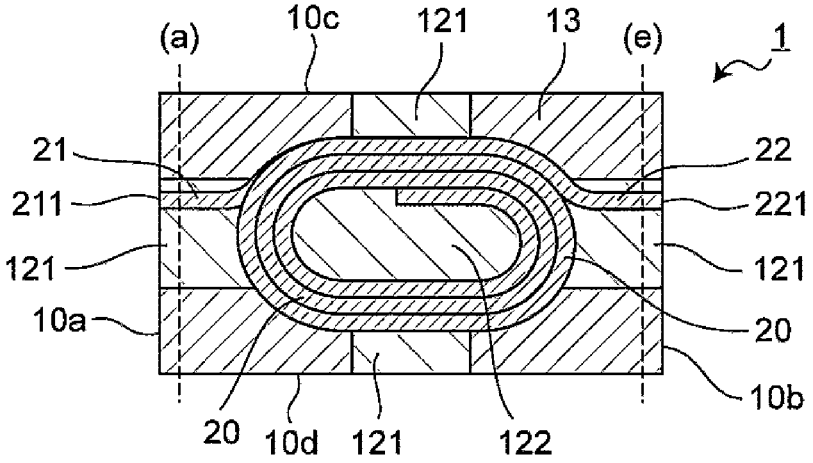
FIG. 11 is a cross-sectional view of a coil component showing a position of a cross-section of an extended portion, which passes through an upper surface of a coil conductor, according to one embodiment of the present disclosure.
Figure 12:
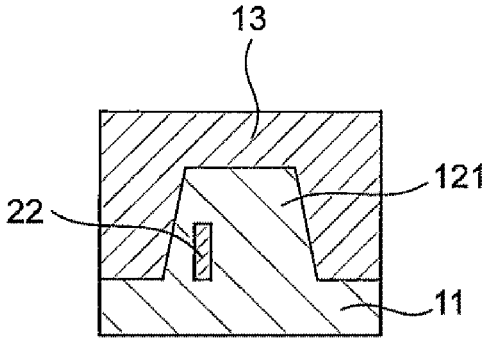
FIG. 12 is a schematic view illustrating an example of a position of the extended portion in a cross-section of the coil component illustrated in FIG. 11 taken along a line (a)
Figure 13:
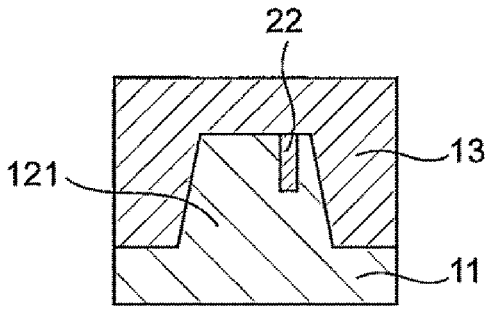
FIG. 13 is a schematic view illustrating an example of a position of the extended portion in a cross-section of the coil component illustrated in FIG. 11 taken along a line (e)
Figure 14:
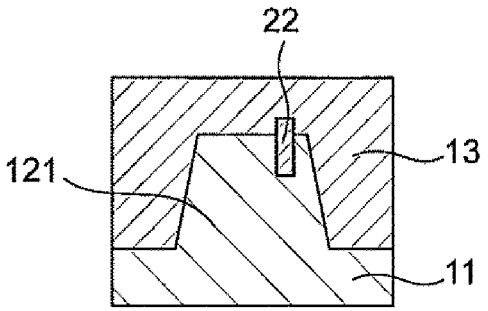
FIG. 14 is a schematic view illustrating another example of the position of the extended portion in the cross-section of the coil component illustrated in FIG. 11 taken along the line (e)

Next, the position of the extended portion of the coil component 1 will be described in more detail with reference to FIG. 11 to FIG. 14. FIG. 11 is a cross-sectional view of the coil component 1 according to one embodiment of the present disclosure, which passes through the upper surface of the coil conductor 20, FIG. 12 illustrates a position of the extended portion in a cross-section of the coil component 1 illustrated in FIG. 11 taken along a line (a), FIG. 13 illustrates an example of the position of the extended portion in a cross-section of the coil component 1 illustrated in FIG. 11 taken along a line (e), and FIG. 14 illustrates another example of the position of the extended portion in a cross-section of the coil component 1 illustrated in FIG. 11 taken along the line (e).

It is preferable that the entirety of at least one of the first extended portion 21 and the second extended portion 22 of the coil conductor 20 except for end surfaces thereof (indicated by reference numerals 211 and 221, respectively) be embedded in the outer convex portion 121 of the first magnetic body portion 11. For example, in a configuration example illustrated in FIG. 12, the entirety of the first extended portion 21 of the coil conductor 20 except for the end surface 211 thereof is embedded in the outer convex portion 121. Note that, as illustrated in FIG. 11, the end surface 211 of the first extended portion 21 is exposed on the side surface of the element body 10. In the case where the entirety of at least one of the first extended portion 21 and the second extended portion 22 is embedded in the outer convex portion 121 as described above, it is possible to further suppress the occurrence of the positional deviation of the first extended portion 21 and/or the second extended portion 22. As a result, it is possible to more reliably secure the connection between the extended portion and the outer electrode.

Alternatively, only a part of the first extended portion 21 and/or the second extended portion 22 of the coil conductor 20 may be embedded in the outer convex portion 121. For example, as illustrated in FIG. 13, a portion of the second extended portion 22 except for an upper surface (and the end surface 221) may be embedded in the outer convex portion 121. In a configuration example illustrated in FIG. 13, the upper surface of the second extended portion 22 of the coil conductor 20 and the upper surface of the outer convex portion 121 are flush with each other. In another example illustrated in FIG. 14, a portion of the second extended portion 22 except for a part of the upper surface and the side surfaces (and the end surfaces 221) thereof may be embedded in the outer convex portion 121. In a configuration example illustrated in FIG. 14, a part of the second extended portion 22 of the coil conductor 20 is provided at a position protruding from the upper surface of the outer convex portion 121 of the first magnetic body portion 11.

Hereinafter, the components of the coil component 1 according to the present disclosure will be described in more detail.

First Magnetic Body Portion 11 and Second Magnetic Body Portion 13

The first magnetic particles and the second magnetic particles contained in the first magnetic body portion 11 and the second magnetic body portion 13 may be metal magnetic body particles as described above. The metal magnetic body configuring the metal magnetic body particles may be, for example, equal to or more than one material selected from the group consisting of Fe—Si—Cr alloy, Fe (carbonyl), electromagnetic soft iron (Fe), silicon steel (Fe-3Si), iron-aluminum (Fe-3.5Al), Alpalm (Fe-16Al), Permendur (Fe-50Co-2V), Sendust (Fe-9.5Si-5.5Al), 45 permalloy (Fe-45Ni), 78 permalloy (Fe-78.5Ni), Supermalloy (Fe-95Ni-5Mo), Mumetal (Fe-77Ni-2Cr-5Cu), Hard Palm (Fe-79Ni-9Nb), Iron-based amorphous (Fe-5Si-3B), and Co-based amorphous ($Co_{81.8}$—$Fe_{4.2}$—$Ni_{4.2}$—$Si_{10}$—$B_{20}$).

The first magnetic body portion 11 and/or the second magnetic body portion 13 preferably further contain a resin. In a case where the first magnetic body portion 11 and/or the second magnetic body portion 13 contain a resin, the magnetic particles (the first magnetic particles and/or the second magnetic particles) can be bonded to each other using the resin, and as a result, the element body strength of the first magnetic body portion 11 and/or the second magnetic body portion 13 can be improved. In addition, in a case where the first magnetic body portion 11 and/or the second magnetic body portion 13 contain a resin, the first magnetic body portion 11 and the second magnetic body portion 13 can be coupled to each other using the resin, and as a result, bonding strength between the first magnetic body portion 11 and the second magnetic body portion 13 can be further increased. The resin may be, for example, an epoxy resin and/or a phenoxy resin. The first magnetic body portion 11 and/or the second magnetic body portion 13 may further contains, in addition to the magnetic particles (the first magnetic particles and/or the second magnetic particles) and the resin, a curing agent, a curing accelerator, a filler, a flame retardant, a coupling agent, a dispersant, a surface treatment agent, a leveling agent, a low-elasticity rubber component, low-elasticity rubber particles, an adhesion-imparting agent and/or a thixotropic agent, or the like.

As illustrated in FIG. 2 and FIG. 4 to FIG. 11, the outer convex portion 121 may be exposed to the side surface of the element body 10. The shape of the outer convex portion 121 is not particularly limited, and may be substantially trapezoidal in a cross-sectional view as illustrated in FIG. 3A, FIG. 3C, and FIG. 12 to FIG. 14. In consideration of processability and the like by the mold, the shape of the outer convex portion 121 is preferably a shape that gradually narrows in a cross-sectional view, and may be, for example, a substantially semi-circular shape or the like.

The number of the outer convex portions 121 is not particularly limited, and for example, the first magnetic body portion 11 may include one to nine outer convex portions 121. The arrangement of the outer convex portion 121 surrounding the winding portion of the coil conductor 20 is not particularly limited, and may be, for example, a + (plus)-shape in a plan view as illustrated in FIG. 2 and FIG. 9, an X-shape in a plan view as illustrated in FIG. 4, FIG. 5, and FIG. 10, or a Y-shape in a plan view as illustrated in FIG. 8.

It is preferable that a maximum width of the outer convex portion 121 be smaller than a width of the winding portion of the coil conductor 20. In a case where the maximum width of the outer convex portion 121 is smaller than the width of the winding portion of the coil conductor 20, the positional deviation of the coil conductor 20 can be more effectively suppressed. In addition, it is preferable that the maximum width of the outer convex portion 121 be approximately equal to or more than ¼ and equal to or less than ⅚ of the width of the element body 10 on the side surface of the element body 10 on which the outer convex portion 121 is exposed. Also, when viewed from the winding axis direction of the coil conductor 20, a total area of the outer convex portion 121 and the inner convex portion 122 in the entire area of the first magnetic body portion 11 is preferably equal to or more than about 5% and equal to or less than about 97% (i.e., from about 5% to about 97%), more preferably equal to or more than about 10% and equal to or less than about 80% (i.e., from about 10% to about 80%), and still more preferably equal to or more than about 10% and equal to or less than about 70% (i.e., from about 10% to about 70%).

Coil Conductor 20

The shape of the coil conductor 20 is not particularly limited, and may be, for example, a substantially elliptical shape or a substantially circular shape. Although the coil conductor 20 illustrated in FIG. 1 is an α-winding coil, the way of winding the coil is not particularly limited. The coil conductor 20 may have a dimension of, for example, about 1.3 mm in a long side direction, about 0.5 mm in a short side direction, and about 0.5 mm in a height direction in a case where the coil component 1 has a size 1608.

First Outer Electrode 31 and Second Outer Electrode 32

The first outer electrode 31 and the second outer electrode 32 may be formed of a metal conductor such as Ag, Cu, Ni, or Sn, and may further contain glass. The outer electrode (the first outer electrode 31 and the second outer electrode 32) can be formed by applying a conductive paste including a metal conductor to the element body 10 and baking the conductive paste. A plating layer may be further formed on a surface of the outer electrode. In addition, the outer electrode may be formed by sputtering or direct plating, instead of a method using a conductive paste.

Insulator Portion

The element body 10 preferably further includes an insulator portion between the first magnetic body portion 11 and the second magnetic body portion 13. The composition of the insulator portion can be appropriately adjusted depending on the desired characteristics. For example, by providing a layer having a lower magnetic permeability than that of the first magnetic body portion 11 and the second magnetic body portion 13 as the insulator portion, it is possible to further improve the DC superposition characteristics of the coil component 1. Alternatively, by providing a layer made of a nonmagnetic material as the insulator portion between the first magnetic body portion 11 and the second magnetic body portion 13, it is possible to further improve the DC superposition characteristics of the coil component 1. Alternatively, it is possible to further increase inductance of the coil component 1 by providing a layer having a higher magnetic permeability than that of the first magnetic body portion 11 and the second magnetic body 13 as the insulator portion. The insulator portion may be configured of a single layer and may be configured of a plurality of layers having different compositions.

Further, by providing a magnetic body portion having a larger resin content than the first magnetic body portion 11 and the second magnetic body portion 13 as the insulator portion, it is possible to further increase the bonding strength between the first magnetic body portion 11 and the second magnetic body portion 13. For example, in order to improve the magnetic permeability, by increasing the content of the magnetic particles in the first magnetic body portion 11 and the second magnetic body portion 13 (i.e., reducing the content of the resin), and by providing an insulator portion having a high resin content between the first magnetic body portion 11 and the second magnetic body portion 13, it is possible to achieve higher magnetic permeability and higher bonding strength.

The dimension of the element body 10 of the coil component 1 according to the present embodiment is not particularly limited, and may be, for example, the size 1608, a size 2012, a size 2520, or the like.

Method for Manufacturing Coil Component

Next, a method for manufacturing the coil component 1 according to one embodiment of the present disclosure will be described below. However, the method described below is merely an example, and the method for manufacturing the coil component 1 according to the present disclosure is not limited to the following method.

The method for manufacturing the coil component 1 includes a process of preparing a mold having a concave portion having a predetermined shape (mold preparation process), a process of disposing the coil conductor 20 in the mold (coil conductor disposing process), a process of pressing the first magnetic sheet against the mold (first magnetic sheet pressing process), a process of removing the coil conductor 20 and the first magnetic sheet from the mold (removing process), a process of pressing the second magnetic sheet on the first magnetic sheet and the coil conductor 20 to obtain a multilayer body (second magnetic sheet pressing process), and a process of cutting the multilayer body in a predetermined dimension to obtain the coil component 1 (cutting process).

Mold Preparation Process

Figure 15:
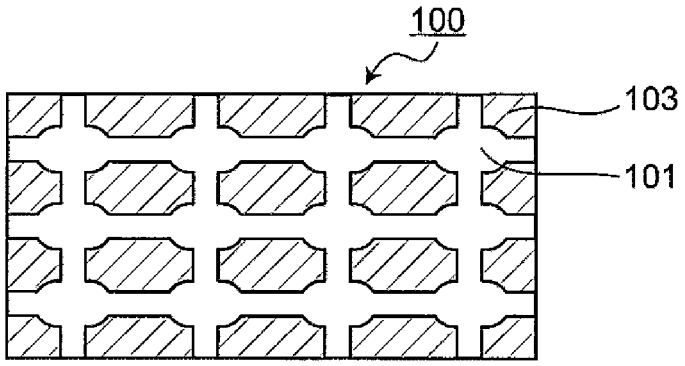
FIG. 15 is a schematic view illustrating an example of a mold used for manufacturing the coil component according to one embodiment of the present disclosure.

First, a mold having a concave portion corresponding to the outer dimension of the winding portion of the coil conductor 20 and one or a plurality of substantially groove-shaped concave portions that is located at an outer side portion of the concave portion and extends from the concave portion is prepared. FIG. 15 illustrates an example of a mold 100. The mold 100 has a concave portion 101 and a convex portion 103. A mold release agent or the like may be applied to the mold 100 in advance. Further, in a case where the element body 10 includes the insulator portion, a magnetic sheet or the like that serves as a third magnetic body portion may be applied to the mold 100 in advance. The shape of the concave portion 101 of the mold may be appropriately set according to the shape of the coil conductor 20 and the width of the outer convex portion 121 in the coil component 1 of a finished product. For example, a depth of the concave portion 101 corresponding to the outer convex portion 121 and a depth of the concave portion 101 corresponding to the inner convex portion 122 may be different from each other. Further, in a case where the depth of the concave portion 101 corresponding to the coil conductor 20 is deeper than the depth of the concave portion 101 corresponding to the inner convex portion 122, it is possible to more effectively suppress the positional deviation of the coil conductor 20.

Coil Conductor Disposing Process

Next, the coil conductor 20 is disposed in the mold 100. At least a part of the winding portion of the coil conductor 20 is disposed inside the concave portion 101 in a manner such that the winding axis is substantially perpendicular to the bottom surface of the concave portion, and at least a part of at least one of the first extended portion 21 and the second extended portion 22 of the coil conductor is disposed inside the substantially groove-shaped concave portion 101. In the present specification, "substantially perpendicular" means within a range of 90°±10°.

First Magnetic Sheet Pressing Process

Next, a first magnetic sheet 111 containing the first magnetic particles is pressed against the mold 100, and at least a part of the coil conductor 20 is embedded in the first magnetic sheet 111. During this embedding, an outer convex portion and an inner convex portion are formed.

The first magnetic sheet 111 can be manufactured by mixing a raw material (additives such as first magnetic particles, a resin, and a curing agent) at a predetermined ratio to be formed in a substantially sheet shape. In the mixing, a viscosity may be adjusted by further adding a solvent. As the solvent, MEK (methyl ethyl ketone), N,N-dimethylformamide (DMF), PGM (propylene glycol monomethyl ether), PMA (propylene glycol monomethyl ether acetate), DPM (dipropylene glycol monomethyl ether), DPMA (dipropylene glycol monomethyl ether acetate) and/or γ-butyrolactone, or the like may be used. The method for forming into a sheet shape is not particularly limited, and by applying a mixture having a resin component that is in an uncured state (A-stage state) on a support substrate formed of a PET film or the like and heating the mixture, the first magnetic sheet 111 made of the resin component in a semi-cured state (B-stage state) can be formed on the support substrate. Heating can be carried out, for example, by means of a hot-air dryer. The resin component in the A-stage state is a component including an epoxy resin and a phenoxy resin in which a curing reaction is not progressed. In addition, the resin component in the B-stage state is a component containing a resin in a state in which the curing reaction of the epoxy resin and the phenoxy resin partially proceeds due to heating of the epoxy resin and the phenoxy resin is heated, but the epoxy resin and the phenoxy resin are not completely cured.

The first magnetic sheet 111 like this is pressed against the mold 100, and at least a part of the coil conductor 20 is embedded in the first magnetic sheet 111. Accordingly, the first magnetic sheet 111 is filled inside the coil conductor 20. The number of the first magnetic sheets 111 is not particularly limited, and only one first magnetic sheet 111 may be pressed and a plurality of first magnetic sheets 111 may be overlapped and pressed. The heating may be performed simultaneously with the pressing process or after the pressing process, and the first magnetic sheet 111 may be cured. The curing conditions may be appropriately set according to the type, the content, and the like of the resin.

Removing Process

Next, the coil conductor 20 and the first magnetic sheet 111 are removed from the mold 100. Convex portions 112 corresponding to the outer convex portion 121 and the inner convex portion 122 are formed on a surface of the first magnetic sheet 111 taken out from the mold 100.

Second Magnetic Sheet Pressing Process

Figure 16:
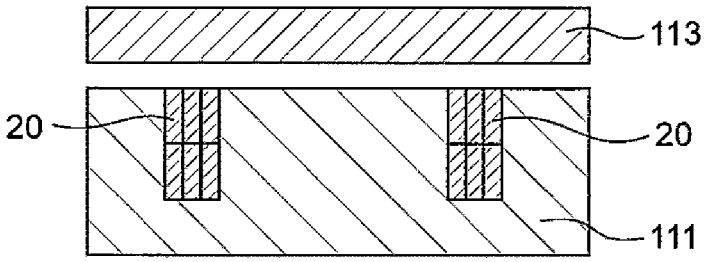
FIG. 16 is a schematic cross-sectional view explaining a manufacturing process of the coil component according to one embodiment of the present disclosure.
Figure 17:
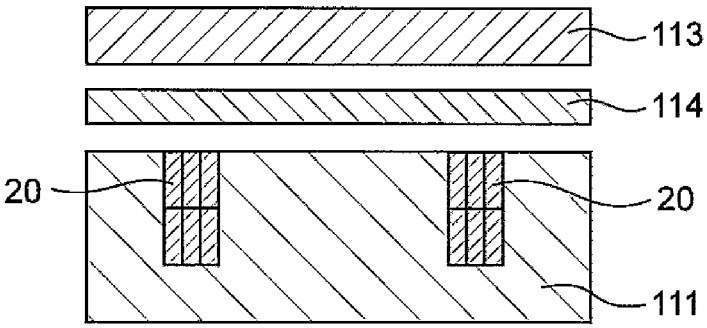
FIG. 17 is a schematic cross-sectional view explaining a manufacturing process of the coil component according to one embodiment of the present disclosure.

Next, a second magnetic sheet 113 containing the second magnetic particles is pressed on the first magnetic sheet 111 and the coil conductor 20 to form a multilayer body in which the first magnetic sheet 111 and the second magnetic sheet 113 are bonded to each other (FIG. 16). In this case, when the element body 10 further including the insulator portion is formed, as illustrated in FIG. 17, a third magnetic sheet 114 may be provided between the first magnetic sheet 111 and the second magnetic sheet 113. The second magnetic sheet 113 and the third magnetic sheet 114 can be manufactured by the same procedure as that of the first magnetic sheet 111. By pressing the second magnetic sheet 113 to the side of the first magnetic sheet 111 where the coil conductor 20 is embedded and pressure-bonded, it is possible to form a multilayer body in which the first magnetic sheet 111 and the second magnetic sheet 113 are bonded to each other. The number of the second magnetic sheets 113 is not particularly limited, and only one second magnetic sheet 113 may be pressed, and a plurality of second magnetic sheets 113 may be overlapped and pressed. The heating may be performed simultaneously with the pressing process or after the pressing process, and the second magnetic sheet 113 may be cured. The curing conditions may be appropriately set according to the type, the content, and the like of the resin.

Cutting Process

Next, the multilayer body is cut to a predetermined dimension, and the coil component 1 is obtained. The cutting can be performed by, for example, dicing or the like. The singulated coil component 1 may be subjected to polishing, such as barrel polishing, for dimension adjustment.

The outer electrodes (the first outer electrode and the second outer electrode) may be formed by applying a conductive paste to both end surfaces (the first side surface 10*a* and the second side surface 10*b* of the element body 10 in the coil component 1 illustrated in FIG. 1) of the coil component obtained in this way, and then baking the conductive paste. A plating layer may be further formed on the surface of the outer electrode. Alternatively, instead of a method using a conductive paste, an outer electrode may be formed by sputtering or direct plating.

The present disclosure includes the following aspects, but the present disclosure is not limited to these aspects.

Aspect 1

A coil component including an element body and a coil conductor provided inside the element body, in which the element body has a substantially rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface. The element body includes a first magnetic body portion containing first magnetic particles, and a second magnetic body portion provided on a main surface of the first magnetic body portion and containing second magnetic particles. The coil conductor includes a winding portion, and a first extended portion and a second extended portion extended to any side surface of the element body. The first magnetic body portion has, on the main surface, an outer convex portion provided at an outer side portion of the winding portion, and an inner convex portion provided at an inner side portion of the winding portion, and the outer convex portion is exposed only on one side surface or on two adjacent side surfaces of the element body.

Aspect 2

The coil component according to Aspect 1, in which at least a part of the first extended portion or the second extended portion is embedded inside the outer convex portion.

Aspect 3

The coil component according to Aspect 1 or 2, in which the first magnetic body portion has a plurality of the outer convex portions on the main surface thereof.

Aspect 4

The coil component according to Aspect 3, in which the first magnetic body portion has the four outer convex portions. A first outer convex portion is exposed only on the first side surface of the element body, a second outer convex portion is exposed only on the second side surface of the element body, a third outer convex portion is exposed only on the third side surface of the element body, and a fourth outer convex portion is exposed only on the fourth side surface of the element body. Also, at least a part of the first extended portion is embedded in the first outer convex portion, and at least a part of the second extended portion is embedded in the second outer convex portion.

Aspect 5

The coil component according to Aspect 3, in which the first magnetic body portion has the four outer convex portions. A first outer convex portion is exposed only on the first side surface and the third side surface of the element body, a second outer convex portion is exposed only on the second side surface and the fourth side surface of the element body, a third outer convex portion is exposed only on the second side surface and the third side surface of the element body, and a fourth outer convex portion is exposed only on the first side surface and the fourth side surface of the element body. At least a part of the first extended portion is embedded in the first outer convex portion, and at least a part of the second extended portion is embedded in the second outer convex portion.

Aspect 6

A coil component including an element body and a coil conductor provided inside the element body, in which the element body has a substantially rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface. The element body includes a first magnetic body portion containing first magnetic particles, and a second magnetic body portion provided on a main surface of the first magnetic body portion and containing second magnetic particles. The coil conductor includes a winding portion, and a first extended portion and a second extended portion. The first magnetic body portion has four outer convex portions provided at an outer side portion of the winding portion on the main surface of the first magnetic body portion. A first outer convex portion is exposed only on the first side surface of the element body, a second outer convex portion is exposed only on the second side surface of the element body, a third outer convex portion is exposed only on the third side surface of the element body, and a fourth outer convex portion is exposed only on the fourth side surface of the element body. Also, at least a part of the first extended portion is embedded in the first outer convex portion, and at least a part of the second extended portion is embedded in the second outer convex portion.

Aspect 7

A coil component including an element body and a coil conductor provided inside the element body, in which the element body has a substantially rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface. The element body includes a first magnetic body portion containing first magnetic particles, and a second magnetic body portion provided on a main surface of the first magnetic body portion and containing second magnetic particles. The coil conductor includes a winding portion, and a first extended portion and a second extended portion. The first magnetic body portion has four outer convex portions provided at an outer side portion of the winding portion on the main surface of the first magnetic body portion. A first outer convex portion is exposed only on the first side surface and the third side surface of the element body, a second outer convex portion is exposed only on the second side surface and the fourth side surface of the element body, a third outer convex portion is exposed only on the second side surface and the third side surface of the element body, and a fourth outer convex portion is exposed only on the first side surface and the fourth side surface of the element body. Also, at least a part of the first extended portion is embedded in the first outer convex portion, and at least a part of the second extended portion is embedded in the second outer convex portion.

Aspect 8

The coil component according to any one of Aspects 1 to 7, in which at least one of the first extended portion and the second extended portion is entirely embedded in the outer convex portion except for an end surface of the at least one of the first extended portion and the second extended portion.

Aspect 9

The coil component according to any one of Aspects 1 to 8, in which the first magnetic body portion further contains a resin.

Aspect 10

The coil component according to any one of Aspects 1 to 9, further including a first outer electrode electrically connected to the first extended portion and a second outer electrode electrically connected to the second extended portion.

Aspect 11

The coil component according to any one of Aspects 1 to 10, in which the element body further includes an insulator portion between the first magnetic body portion and the second magnetic body portion.

Aspect 12

A method for manufacturing the coil component according to any one of Aspects 1 to 11. The method includes preparing a mold that has a concave portion corresponding to an outer dimension of the winding portion of the coil conductor, and one or a plurality of substantially groove-shaped concave portions located at an outer side portion of the concave portion and extending from the concave portion; and disposing the coil conductor in the mold, in which at least a part of the winding portion of the coil conductor is disposed inside the concave portion in a manner such that the winding axis is substantially perpendicular to a bottom surface of the concave portion, and at least a part of at least one of the first extended portion and the second extended portion of the coil conductor is disposed inside the substantially groove-shaped concave portion. The method further includes pressing a first magnetic sheet containing first magnetic particles against the mold, and embedding at least a part of the coil conductor in the first magnetic sheet; removing the coil conductor and the first magnetic sheet from the mold; pressing a second magnetic sheet containing second magnetic particles on the first magnetic sheet and the coil conductor to form a multilayer body in which the first magnetic sheet and the second magnetic sheet are bonded to each other; and cutting the multilayer body to a predetermined dimension to obtain a coil component.

The coil component according to the present disclosure can increase the bonding strength between the first magnetic body portion and the second magnetic body portion configuring the element body of the coil component, and thus can be suitably used for applications in which high reliability is required.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element body; and a coil conductor provided inside the element body, wherein the element body has a rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface, the element body includes a first magnetic body portion containing first magnetic particles, and a second magnetic body portion provided on a main surface of the first magnetic body portion and containing second magnetic particles, the coil conductor includes a winding portion, and a first extended portion and a second extended portion extended to any side surface of the element body, the first magnetic body portion has, on the main surface, an outer convex portion provided at an outer side portion of the winding portion, and an inner convex portion provided at an inner side portion of the winding portion, the outer convex portion is exposed only on one side surface or on two adjacent side surfaces of the element body, and at least a part of the first extended portion is embedded inside the outer convex portion such that an edge of the at least a part of the first extended portion transverse to a lengthwise direction of the first extended portion is exposed from the outer convex portion, or at least a part of the second extended portion is embedded inside the outer convex portion such that an edge of the at least a part of the second extended portion transverse to a lengthwise direction of the second extended portion is exposed from the outer convex portion.

2. The coil component according to claim 1, wherein the first magnetic body portion has a plurality of the outer convex portions on the main surface.

3. The coil component according to claim 2, wherein the first magnetic body portion has the four outer convex portions, a first outer convex portion is exposed only on the first side surface of the element body, a second outer convex portion is exposed only on the second side surface of the element body, a third outer convex portion is exposed only on the third side surface of the element body, a fourth outer convex portion is exposed only on the fourth side surface of the element body, and at least a part of the first extended portion is embedded in the first outer convex portion, and at least a part of the second extended portion is embedded in the second outer convex portion.

4. The coil component according to claim 2, wherein the first magnetic body portion has the four outer convex portions, a first outer convex portion is exposed only on the first side surface and the third side surface of the element body, a second outer convex portion is exposed only on the second side surface and the fourth side surface of the element body, a third outer convex portion is exposed only on the second side surface and the third side surface of the element body, a fourth outer convex portion is exposed only on the first side surface and the fourth side surface of the element body, and at least a part of the first extended portion is embedded in the first outer convex portion, and at least a part of the second extended portion is embedded in the second outer convex portion.

5. A coil component comprising:

an element body; and a coil conductor provided inside the element body, wherein the element body has a rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface, the element body includes a first magnetic body portion containing first magnetic particles, and a second magnetic body portion provided on a main surface of the first magnetic body portion and containing second magnetic particles, the coil conductor includes a winding portion, and a first extended portion and a second extended portion, the first magnetic body portion has four outer convex portions provided at an outer side portion of the winding portion, on the main surface, a first outer convex portion is exposed only on the first side surface of the element body, a second outer convex portion is exposed only on the second side surface of the element body, a third outer convex portion is exposed only on the third side surface of the element body, a fourth outer convex portion is exposed only on the fourth side surface of the element body, and at least a part of the first extended portion is embedded in the first outer convex portion such that an edge of the at least a part of the first extended portion transverse to a lengthwise direction of the first extended portion is exposed from the first outer convex portion, and at least a part of the second extended portion is embedded in the second outer convex portion such that an edge of the at least a part of the second extended portion transverse to a lengthwise direction of the second extended portion is exposed from the second outer convex portion.

6. A coil component comprising:

an element body; and a coil conductor provided inside the element body, wherein the element body has a rectangular shape and has an upper surface and a lower surface facing each other in a direction of a winding axis of the coil conductor, a first side surface and a second side surface facing each other in a direction orthogonal to the winding axis, and a third side surface and a fourth side surface facing each other in a direction orthogonal to the winding axis and parallel to the first side surface and the second side surface, the element body includes a first magnetic body portion containing first magnetic particles, and a second magnetic body portion provided on a main surface of the first magnetic body portion and containing second magnetic particles, the coil conductor includes a winding portion, and a first extended portion and a second extended portion, the first magnetic body portion has four outer convex portions provided at an outer side portion of the winding portion, on the main surface, a first outer convex portion is exposed only on the first side surface and the third side surface of the element body, a second outer convex portion is exposed only on the second side surface and the fourth side surface of the element body, a third outer convex portion is exposed only on the second side surface and the third side surface of the element body, a fourth outer convex portion is exposed only on the first side surface and the fourth side surface of the element body, and at least a part of the first extended portion is embedded in the first outer convex portion such that an edge of the at least a part of the first extended portion transverse to a lengthwise direction of the first extended portion is exposed from the first outer convex portion, and at least a part of the second extended portion is embedded in the second outer convex portion such that an edge of the at least a part of the second extended portion transverse to a lengthwise direction of the second extended portion is exposed from the second outer convex portion.

7. The coil component according to claim 1, wherein at least one of the first extended portion and the second extended portion is entirely embedded in the outer convex portion except for the edge of the at least one of the first extended portion and the second extended portion.

8. The coil component according to claim 1, wherein the first magnetic body portion further contains a resin.

9. The coil component according to claim 1, further comprising a first outer electrode electrically connected to the first extended portion and a second outer electrode electrically connected to the second extended portion.

10. The coil component according to claim 1, wherein the element body further includes an insulator portion between the first magnetic body portion and the second magnetic body portion.

11. A method for manufacturing the coil component according to claim 1, the method comprising:

preparing a mold that has a concave portion corresponding to an outer dimension of the winding portion of the coil conductor, and one or a plurality of groove-shaped concave portions located at an outer side portion of the concave portion and extending from the concave portion;

disposing the coil conductor in the mold, in which at least a part of the winding portion of the coil conductor is disposed inside the concave portion in a manner such that the winding axis is perpendicular to a bottom surface of the concave portion, and at least a part of at least one of the first extended portion and the second extended portion of the coil conductor is disposed inside the groove-shaped concave portion;

pressing a first magnetic sheet containing the first magnetic particles against the mold, and embedding at least a part of the coil conductor in the first magnetic sheet;

removing the coil conductor and the first magnetic sheet from the mold;

pressing a second magnetic sheet containing the second magnetic particles on the first magnetic sheet and the coil conductor to form a multilayer body in which the first magnetic sheet and the second magnetic sheet are bonded to each other; and cutting the multilayer body to a predetermined dimension to obtain a coil component.

12. The coil component according to claim 5, wherein at least one of the first extended portion and the second extended portion is entirely embedded in the outer convex portion except for the edge an end surface of the at least one of the first extended portion and the second extended portion.

13. The coil component according to claim 6, wherein at least one of the first extended portion and the second extended portion is entirely embedded in the outer convex portion except for the edge of the at least one of the first extended portion and the second extended portion.

14. The coil component according to claim 5, wherein the first magnetic body portion further contains a resin.

15. The coil component according to claim 6, wherein the first magnetic body portion further contains a resin.

16. The coil component according to claim 5, further comprising a first outer electrode electrically connected to the first extended portion and a second outer electrode electrically connected to the second extended portion.

17. The coil component according to claim 6, further comprising a first outer electrode electrically connected to the first extended portion and a second outer electrode electrically connected to the second extended portion.

18. The coil component according to claim 5, wherein the element body further includes an insulator portion between the first magnetic body portion and the second magnetic body portion.

19. The coil component according to claim 6, wherein the element body further includes an insulator portion between the first magnetic body portion and the second magnetic body portion.

* * * * *